US012405073B2

(12) United States Patent
Prinz

(10) Patent No.: US 12,405,073 B2
(45) Date of Patent: Sep. 2, 2025

(54) HAND FIREARM

(71) Applicant: HANS WRAGE & CO. GMBH, Hamburg (DE)

(72) Inventor: Alexander Prinz, Maierhofen (DE)

(73) Assignee: Hans Wrage & Co. GmbH, Hamburg (DE)

( * ) Notice: Subject to any disclaimer, the term of this patent is extended or adjusted under 35 U.S.C. 154(b) by 0 days.

(21) Appl. No.: 18/861,766

(22) PCT Filed: Apr. 24, 2023

(86) PCT No.: PCT/EP2023/060695
§ 371 (c)(1),
(2) Date: Oct. 30, 2024

(87) PCT Pub. No.: WO2023/213600
PCT Pub. Date: Nov. 9, 2023

(65) Prior Publication Data

US 2025/0172360 A1 May 29, 2025

(30) Foreign Application Priority Data

May 2, 2022 (EP) ..... 22171122

(51) Int. Cl.
*F41A 3/40* (2006.01)

(52) U.S. Cl.
CPC ..... *F41A 3/40* (2013.01)

(58) Field of Classification Search
CPC ..... F41A 3/40; F41A 3/36
See application file for complete search history.

(56) References Cited

U.S. PATENT DOCUMENTS

| | | | |
|---|---|---|---|
| 1,487,799 | A | 3/1924 | Pedersen |
| 2,098,727 | A | 11/1937 | Lahti |
| 2,407,157 | A | 9/1946 | Hyde |
| 5,614,691 | A | 3/1997 | Taylor |

FOREIGN PATENT DOCUMENTS

| | | | |
|---|---|---|---|
| DE | 588477 | C | 11/1933 |
| DE | 851619 | C | 10/1952 |
| DE | 19616397 | C2 | 4/2000 |
| DE | 102009011939 | B4 | 11/2015 |
| EP | 2157393 | B1 | 7/2014 |

*Primary Examiner* — J. Woodrow Eldred
(74) *Attorney, Agent, or Firm* — Shumaker, Loop & Kendrick, LLP; James D. Miller

(57) ABSTRACT

A self-loading hand firearm with a barrel secured to a frame, a firing pin, a slide, and a closure which is held, in the front position of the slide, in a locking position on the frame and which is moved from the locking position into a release position by gas pressure of a fired projectile. The closure is formed at least in two parts with a closure locking mechanism, which has two lateral legs, and a closure impact base lying between the legs, the closure locking mechanism being provided at the legs with at least one protruding driver element, which engages in a recess of the slide, and with at least one retaining cam, which engages in a shoulder of the frame. The closure impact base and the closure locking mechanism are hinged to one another.

12 Claims, 8 Drawing Sheets

HAND FIREARM

CROSS REFERENCE TO RELATED PATENT APPLICATIONS

Figures 1, 2:
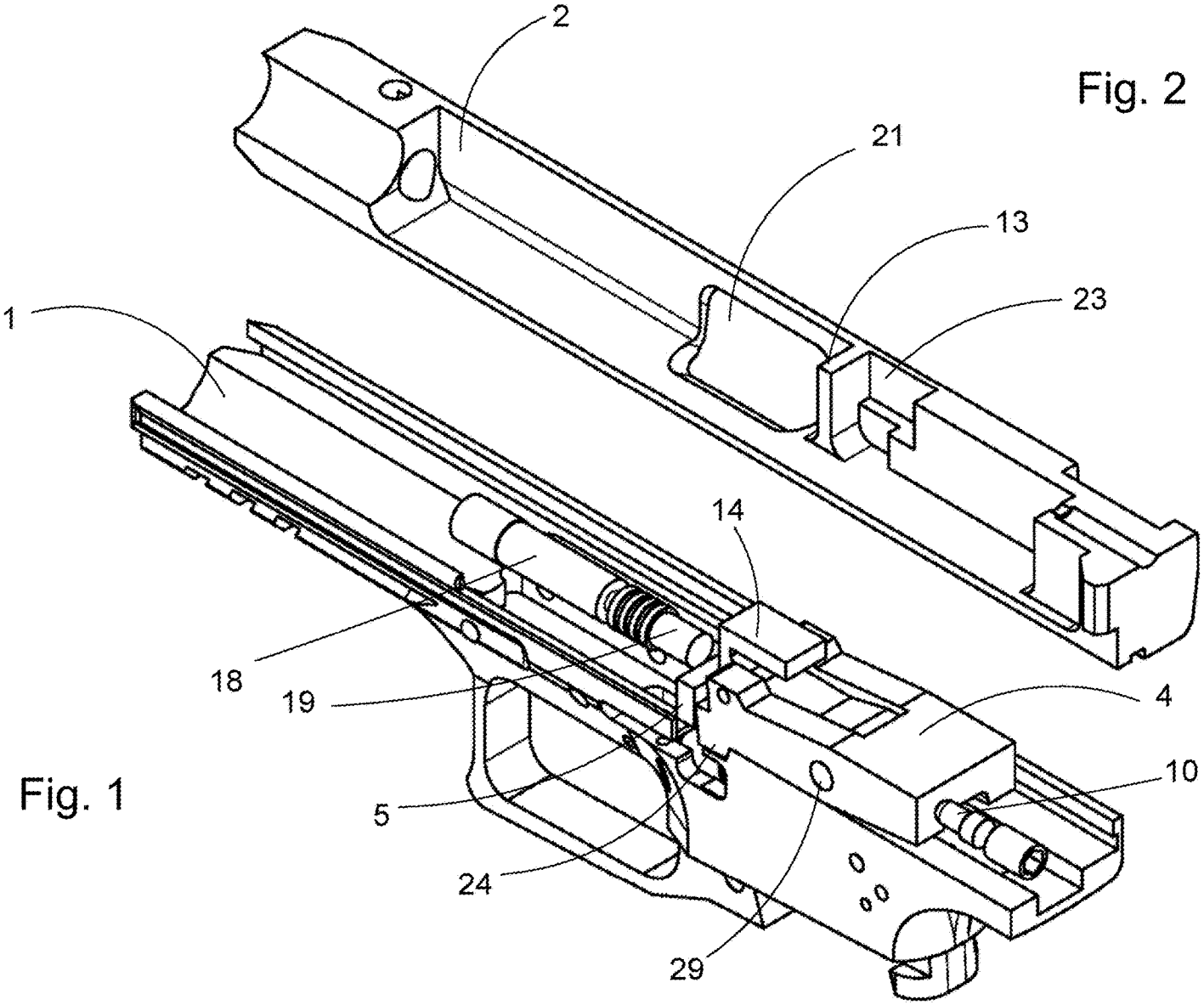

This is a U.S. national phase patent application of PCT/EP2023/060695 filed Apr. 24, 2023, which claims the benefit of and priority to European Patent Application No. EP 22171122.9, filed on May 2, 2022, the entire contents of each of which are incorporated herein by reference for all purposes.

FIELD

The invention relates to a self-loading handgun, in particular a handgun designed as a gas-operated loader.

BACKGROUND

In automatic gas-operated loaders, the gas pressure produced when a shot is fired directs a spring-loaded movable slide to the rear of the pistol, whereby the fired cartridge case is ejected and a new cartridge is fed from a magazine into the cartridge chamber of the barrel upon the subsequent forward movement of the slide. While the shot is being fired, the breech of the weapon is locked. A small portion of the gas pressure created when the shot is fired is directed to a gas cylinder which transfers momentum to the slide and thereby opens the breech so that the cartridge casing can be dislodged from the cartridge chamber and replaced by a new cartridge from a magazine.

Effecting the unblocking of the breech via a sliding guide formed or separately arranged in the slide is known, wherein the breech is lifted or respectively lowered or pivoted.

A self-loading handgun is known from DE 196 16 397 C2 in which a breech block carrier in the form of a slide incorporates a lateral sliding guide into which a control pin formed on a rotatable breech block head is directed. The locking and unlocking of the breech block head thereby ensues by the breech block head rotating relative to a rigidly arranged locking sleeve in that the movement of the breech block head is blocked in a first rotational position and unblocked in a second rotational position, wherein the rotational positions result from the respective position of the control pin in the sliding guide.

DE 10 2009 011 939 B4 describes a locking mechanism for a breech on a weapon which makes use of a sliding guide with slides comprising angled guide curves via which the breech can be locked or unlocked. The structure is relatively complex and therefore unsuitable for a handgun.

EP 2 157 393 B1 describes a gas-operated loader in which the breech has side lugs which engage in locking position in locking grooves of the housing and which makes use of a gas piston for the unlocking to unblock the locking of the side lugs when the shot is fired. The breech is thereby lifted and can be drawn back.

SUMMARY

The invention is based on the task of specifying a handgun provided with a novel locking system which is of mechanically simple structure, easy to disassemble and with which the risk of malfunction is minimized.

This task is solved by the invention specified in the claims. Further developments of the invention are specified in subclaims or disclosed in the description.

The invention is based on a handgun having a barrel immovably secured to a frame, a firing pin, a slide movable relative to the frame, and a breech which, in the forward position of the slide, is held in a locked position on the frame and which, upon a backward movement of the slide effected by gas pressure from a fired projectile, is moved from the locked position into an unlocked position via a gas piston and moved together with the slide into a rear position from which the slide together with the breech is returned to the forward position of the breech under spring force.

According to the characterizing part of claim 1, the breech is of at least two-part design comprising a breech locking mechanism having two lateral limbs and a breech face disposed between the limbs, wherein the breech locking mechanism is provided with at least one protruding driving element on the limbs designed to engage in a recess of the slide and at least one retaining cam designed to engage in a shoulder of the frame.

The breech face and the breech locking mechanism are articulated together and the breech face incorporates an axial bore aligned with the barrel for the passage of a firing pin.

The breech face is guided coaxially to the barrel upon the backward and forward movement of the slide.

The breech is essentially designed in two parts in the invention, wherein the breech face is movable coaxially to the barrel of the weapon and a further part is pivotably connected to the breech face as a breech locking mechanism. The breech base alone thereby moves coaxially to the barrel, which does not require any mass to be moved in the transverse direction, reducing the susceptibility to failure and diminishing the susceptibility to contamination. The breech locking mechanism articulated to the breech face only has the task of establishing or releasing the locking of the breech.

A further advantage of the invention is that the entire structure of the weapon can be of very flat design so that handling is improved due to the lowered center of gravity. Ultimately, the structure of the weapon only has a few moving parts and these are tolerance-insensitive, structurally simple to manufacture and thus able to be used in uncomplicated and malfunction-tolerant manner even under difficult operating conditions. The simple structure and easy disassembly of the weapon also facilitates its maintenance and cleaning.

In a first embodiment of the invention, the driving element is preferably lifted by a hook-like projection connected to the slide which engages behind a connection between the limbs of the breech locking mechanism during the backward movement of the slide and thereby raises the limbs of the breech locking mechanism to release the retaining cam.

In particular, in the locked position of the breech, at least one retaining cam of the breech locking mechanism engages in the shoulder of the frame. Upon the backward movement of the slide, the driving element induces the release of the retaining cam from the shoulder of the frame by lifting the breech locking mechanism so as to thereby unlock the breech.

The driving element is preferably accommodated in a recess in the slide. The recess comprises a front edge which in particular slopes obliquely backwards/downward so as to be able to lift the driving element upon the backward movement of the slide. Upon the forward movement of the slide, the rear edge of the recess engages behind the driving element of the breech locking mechanism and moves it forward again.

In a second embodiment of the invention, the breech is connected to the slide via an articulated connection able to be displaced in the longitudinal direction of the breech such that the at least one driving element is able to engage in the recess of the slide upon the backward movement of the slide and the at least one retaining cam is released from engagement in the shoulder of the frame.

The breech locking mechanism preferably comprises an underside inclination at the rear end which enables a pivoting of the breech locking mechanism vis-à-vis the breech face.

Preferably, the articulated connection between the breech locking mechanism and the slide is realized by means of a locking pin supported in an oval-shaped recess of the breech face running in the longitudinal direction of the weapon.

The oval recess is preferably designed as a semi-oval, its larger diameter running at an angle of 20° to 40° rising towards the rear of the weapon vis-à-vis the longitudinal axis of the weapon. The shifting of the locking pin upon its displacement from the front rest position to the rear return position thereby effects a forced downward movement of the breech locking mechanism, which leads to increased certainty for the entry of the driving element into the recess of the slide.

Preferably, the breech locking mechanism is forcibly guided during the movement of the breech. Upon the momentum exerted on the slide by the gas pressure of the gas piston, the driving element is lifted into a recess in the slide. A rearward inclination of the breech locking mechanism thereby enables a wide breech locking mechanism pivoting range, which increases the certainty of engagement in the recess of the slide.

In order to enable uniformity in the breech locking mechanism's path of movement, the slide surfaces between the driving element and recess of the slide and/or between the retaining cam and shoulder of the frame are preferably designed to be beveled or rounded in the longitudinal direction of the frame.

The invention is not limited to handguns in the form of pistols but rather encompasses any type of self-loading handgun.

DRAWINGS

The invention will be explained in greater detail below on the basis of an exemplary embodiment. The drawings are schematic drawings omitting standard elements such as magazine, trigger, rear sight and front sight as well as fairing. FIGS. 1-9 show a first embodiment and FIGS. 10-15 show a second embodiment of the invention on a pistol.

Figure 3:
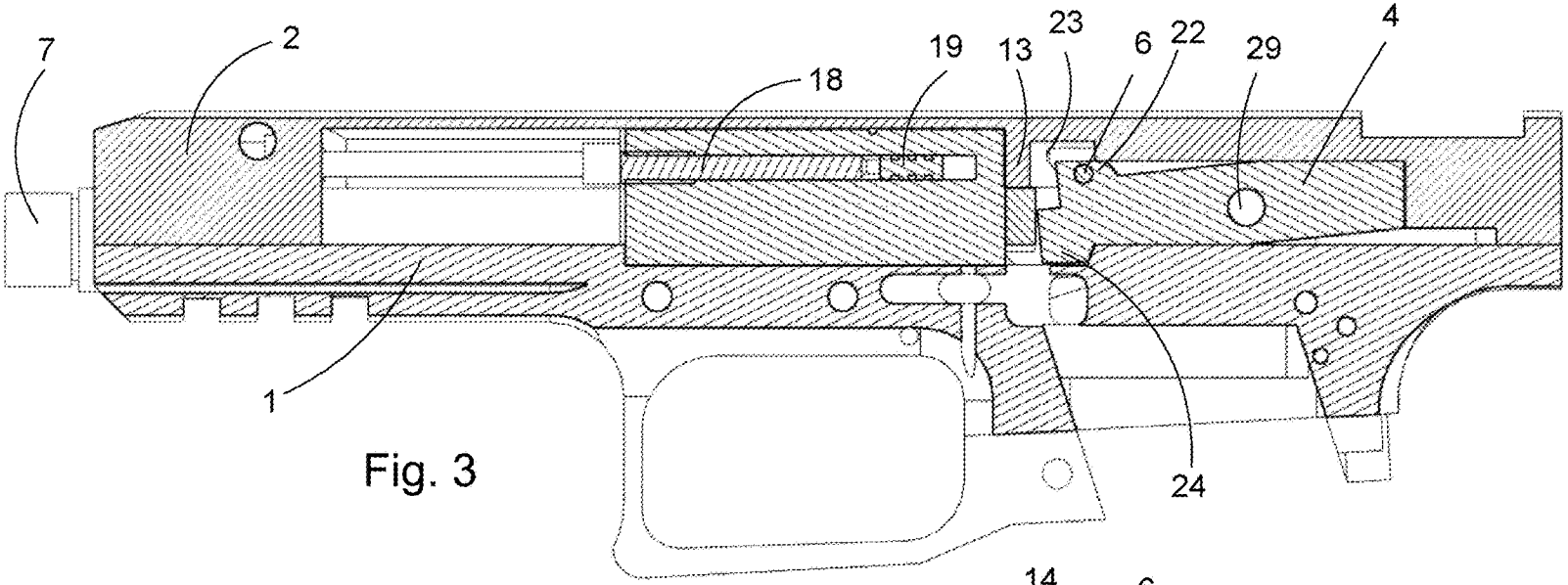
Figure 4:
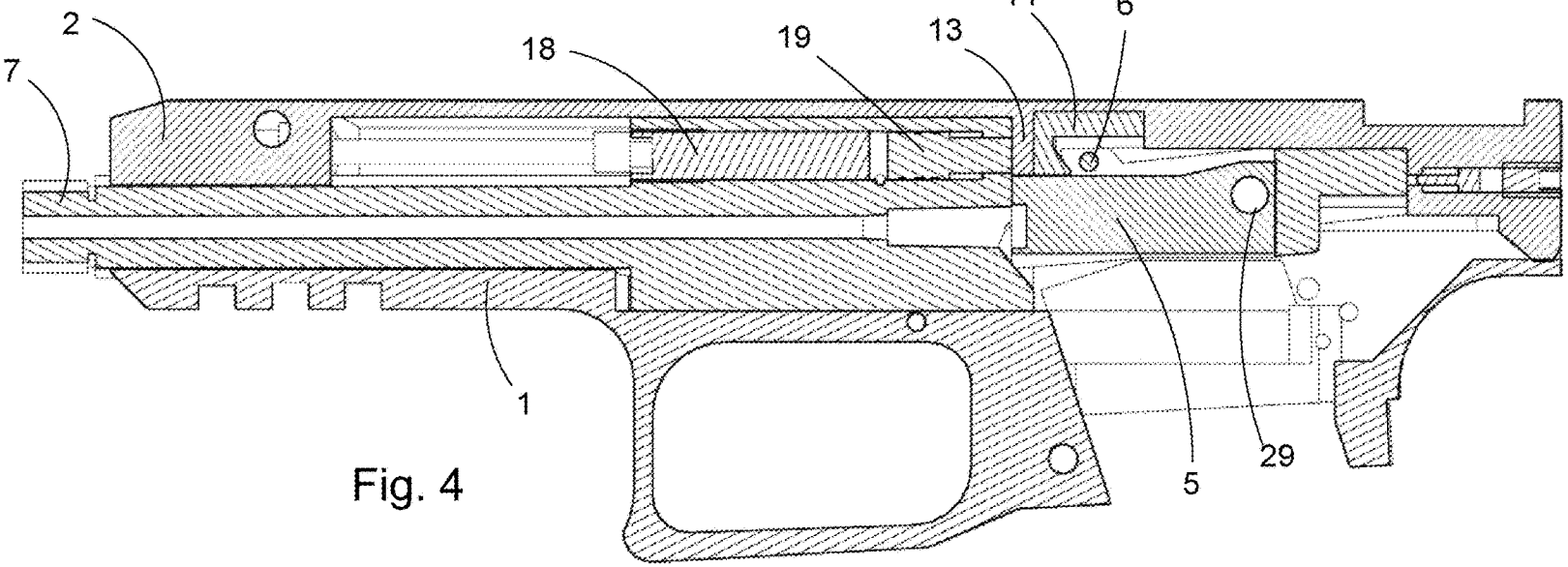
Figure 5:
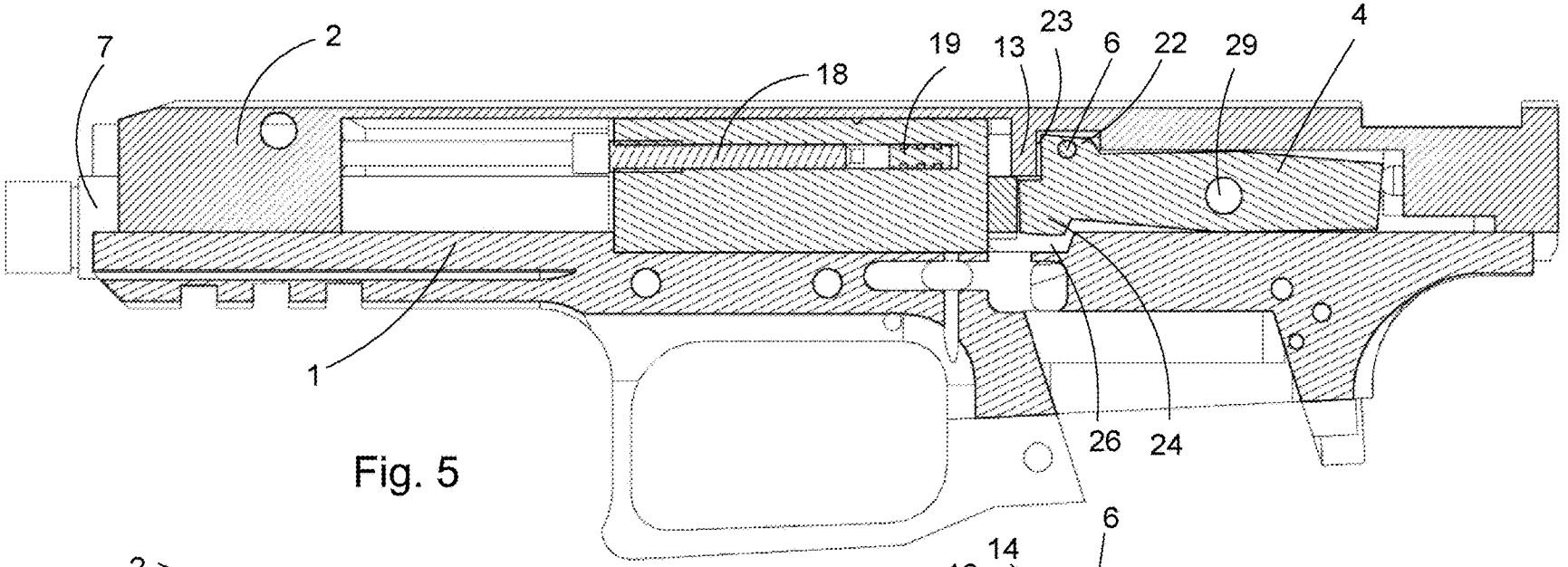
Figure 6:
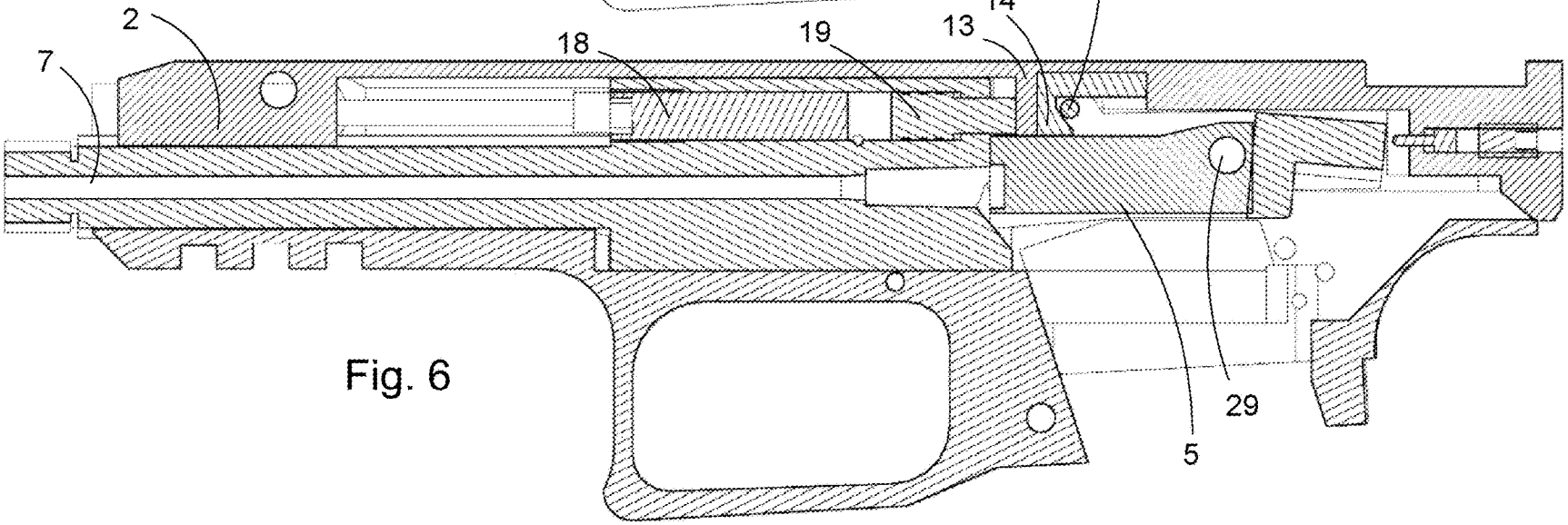
Figure 7:
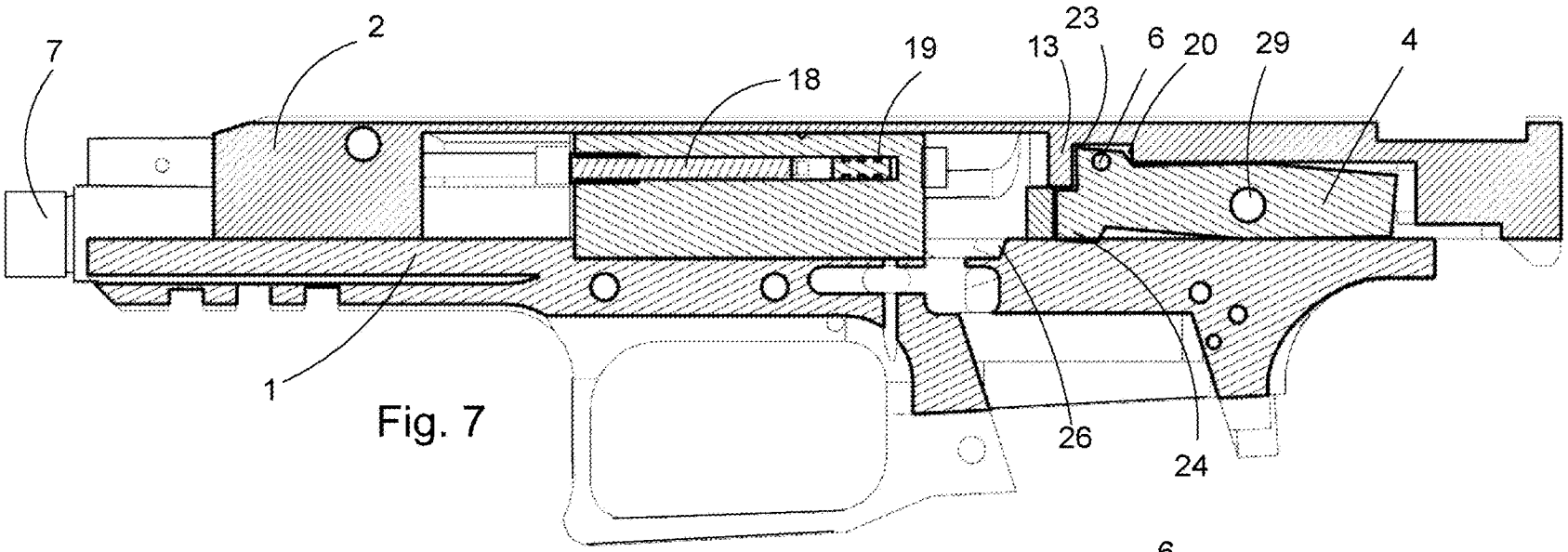
Figure 8:
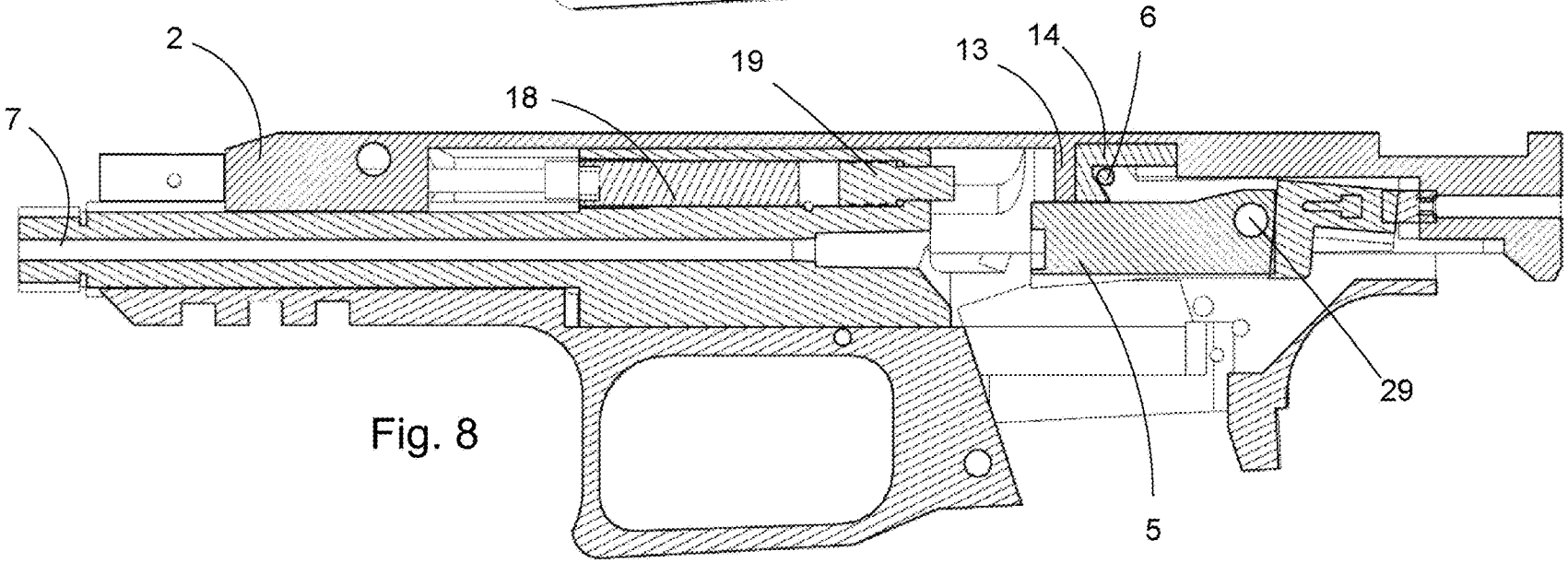
Figure 9A:
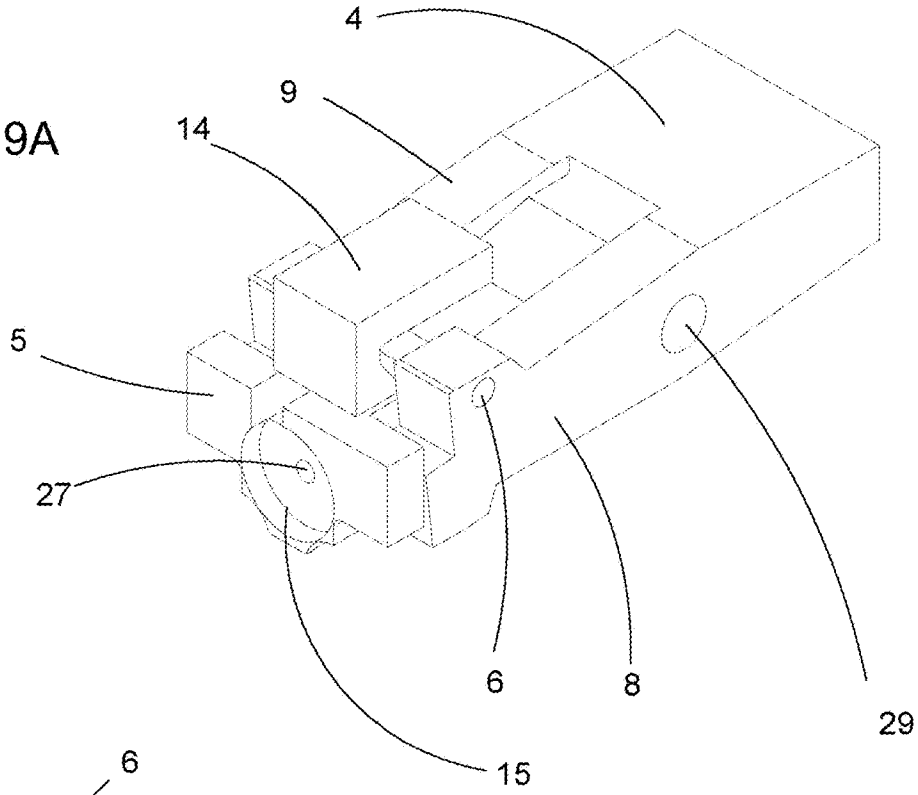
Figure 9B:
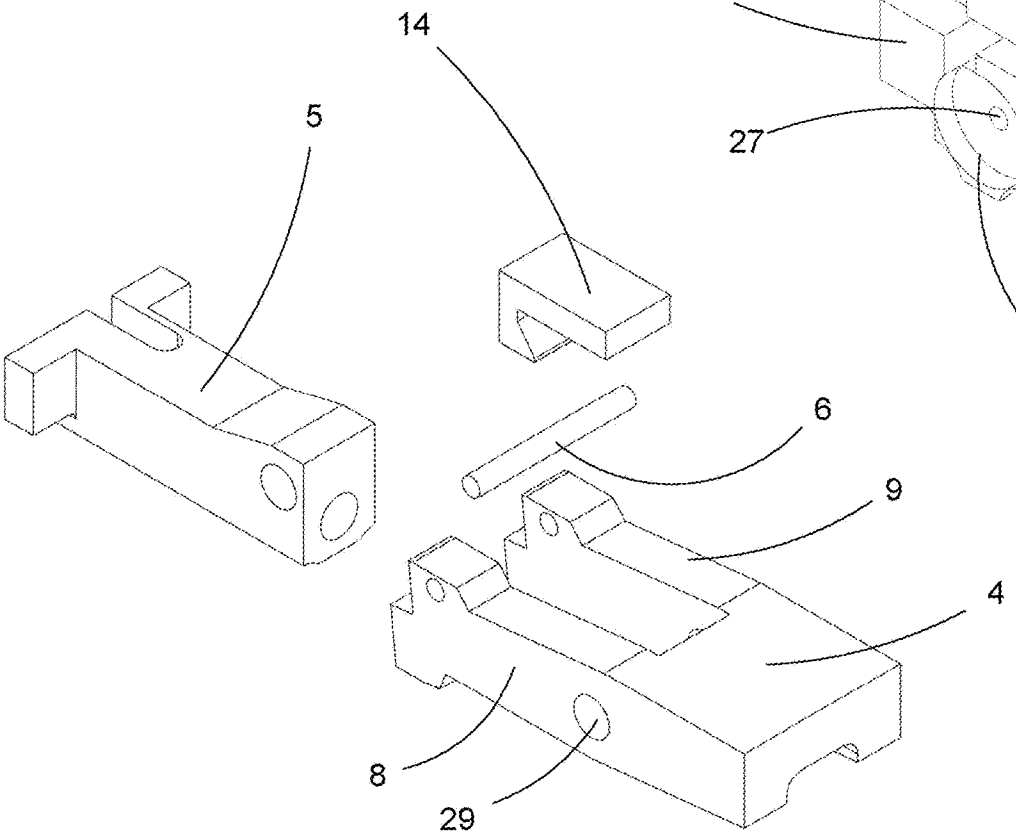
Figure 11:
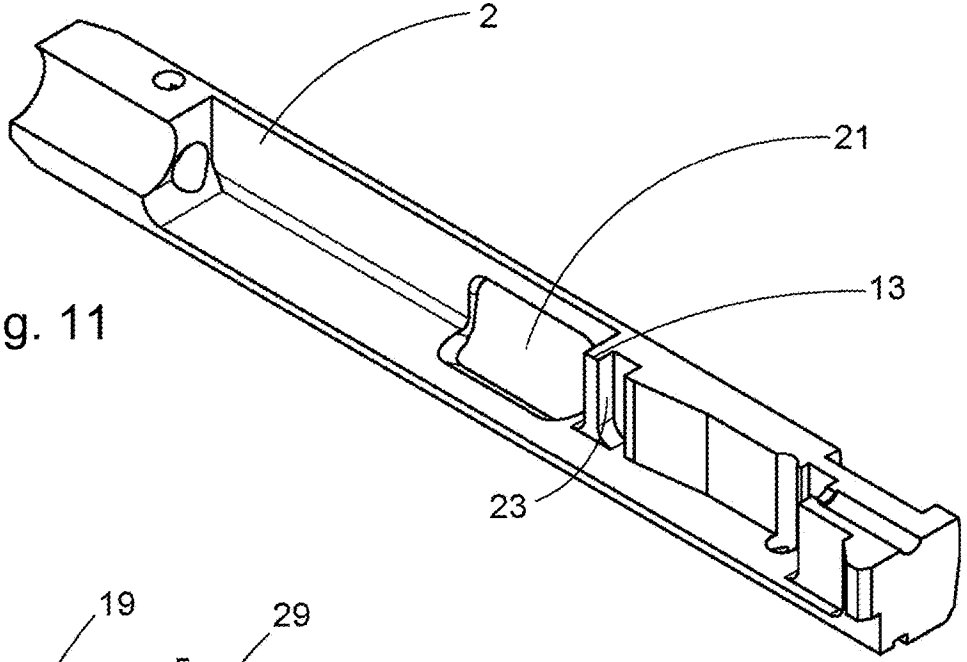
Figure 10:
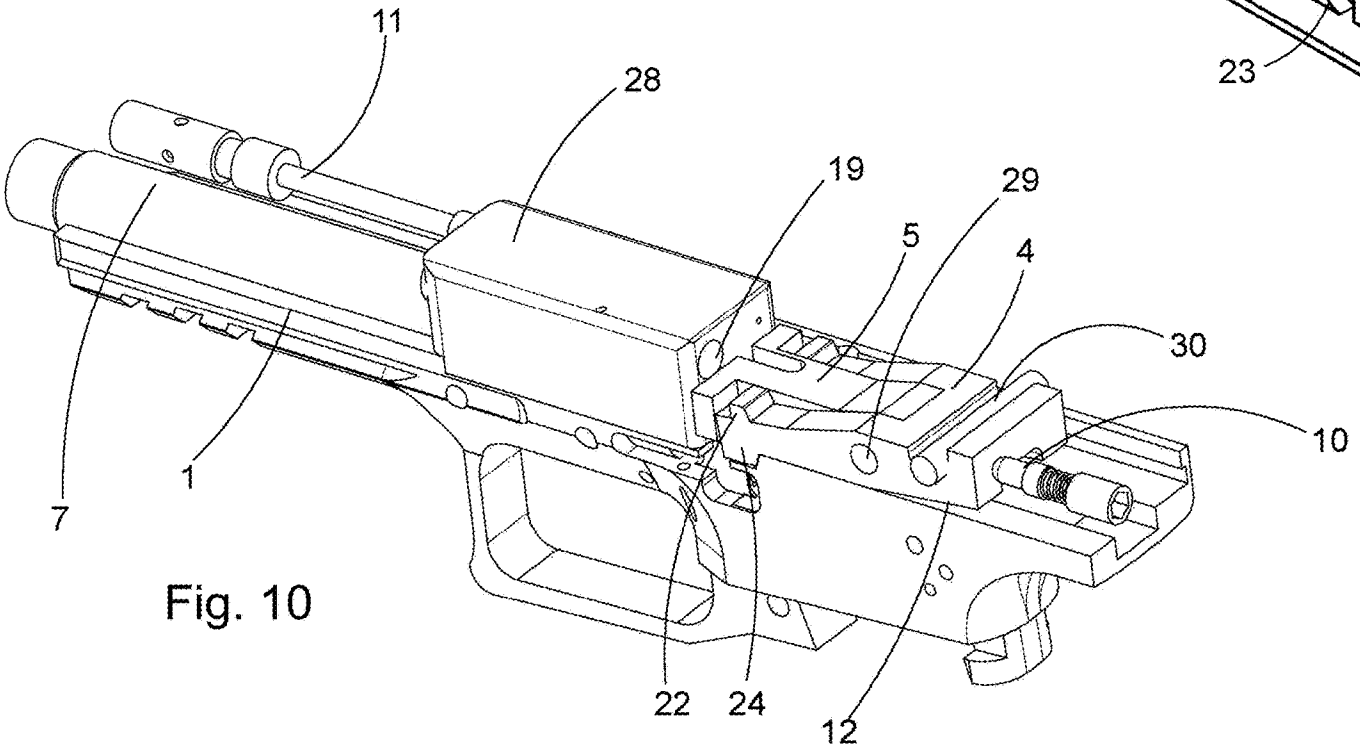
Figure 12:
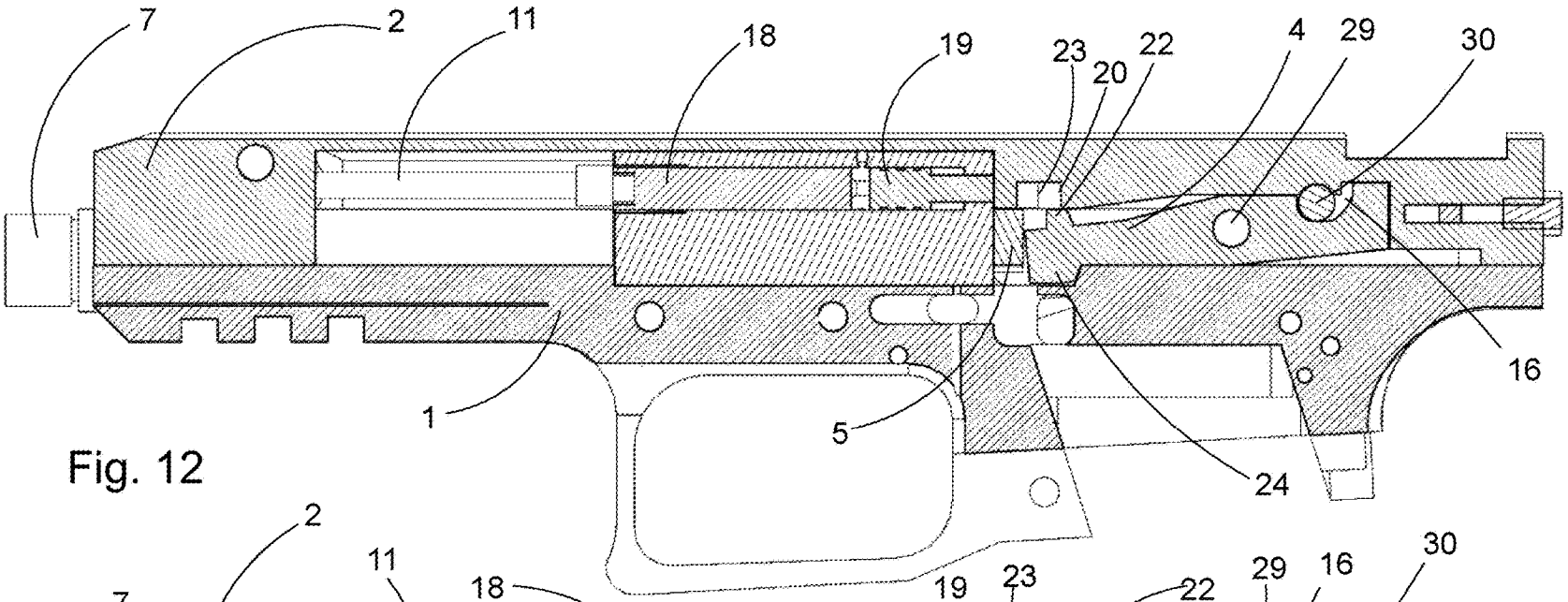
Figure 13:
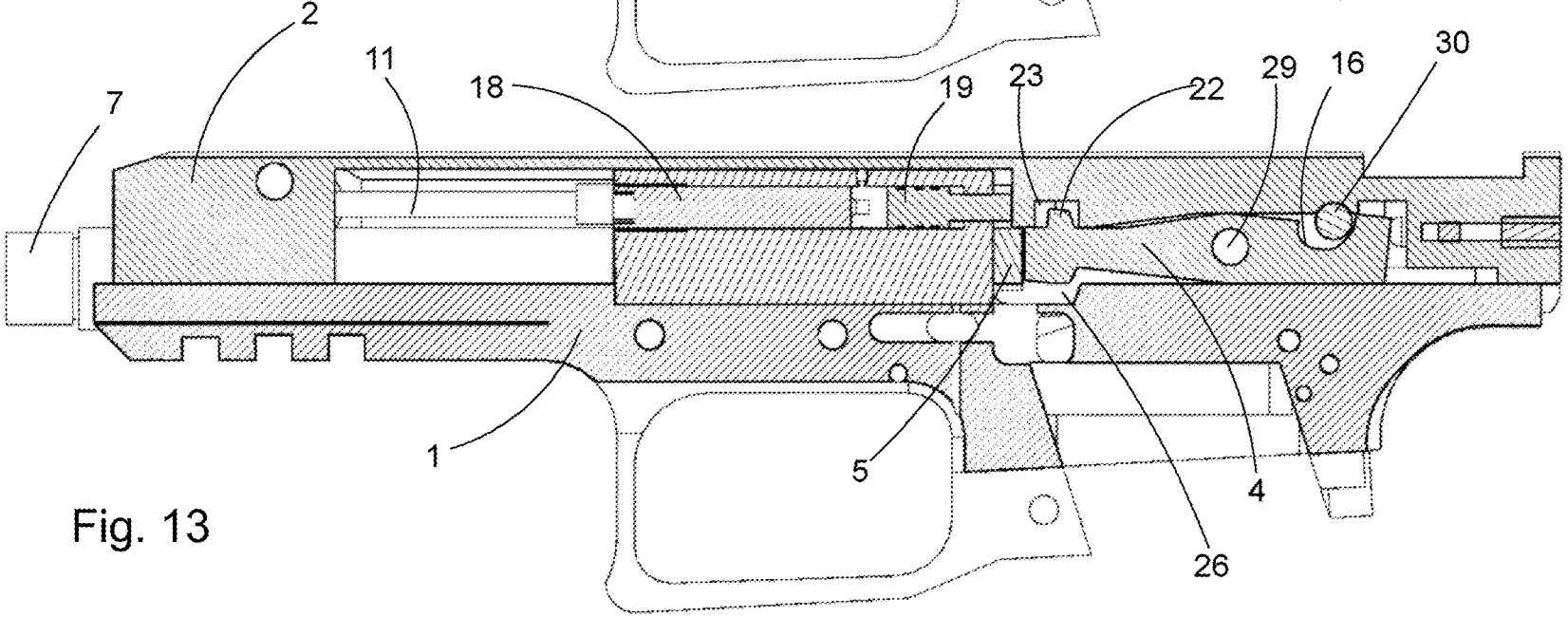
Figure 14:
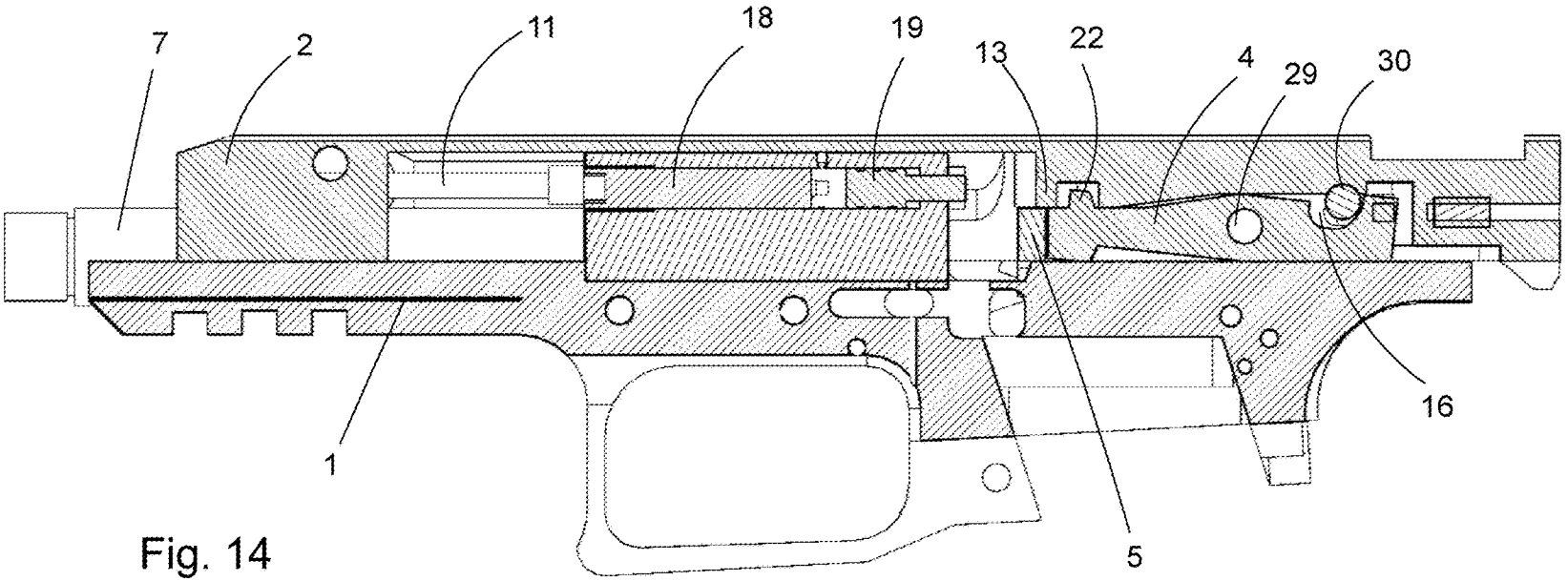
Figure 15:
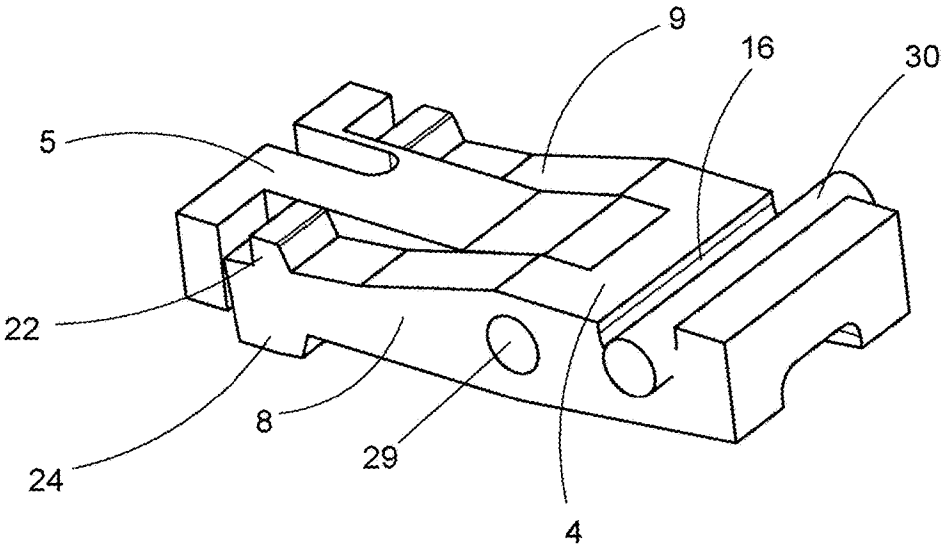

Shown are:

FIG. 1 a perspective depiction of various elements of a pistol of a first embodiment, FIG. 2 a perspective depiction of a slide of a pistol shown rotated 90° about the longitudinal axis compared to FIG. 1, FIG. 3 a side sectional view in a first sectional plane of a pistol according to FIG. 1 in the rest position, FIG. 4 a side sectional view in a second sectional plane of a pistol according to FIG. 1 in the rest position, FIG. 5 a side sectional view in a first sectional plane of a pistol according to FIG. 1 in a position immediately after shot firing, FIG. 6 a side sectional view in a second sectional plane of a pistol according to FIG. 1 in a position immediately after shot firing, FIG. 7 a side sectional view in a first sectional plane of a pistol according to FIG. 1 in a further return position of the slide after shot firing, FIG. 8 a side sectional view in a second sectional plane of a pistol according to FIG. 1 in a further return position of the slide after shot firing, FIG. 9A a breech of a pistol according to FIG. 1 in a perspective depiction, FIG. 9B a breech of a pistol according to FIG. 1 in an exploded depiction, FIG. 10 a perspective view of various elements of a pistol of a second embodiment, FIG. 11 a depiction of the slide of a pistol according to FIG. 10 rotated 90° about the longitudinal axis, FIG. 12 a side sectional view of a pistol according to FIG. 10 in rest position, FIG. 13 a side sectional view of a pistol according to FIG. 10 in a position of the slide immediately after shot firing, FIG. 14 a side sectional view of a pistol according to FIG. 10 in rest position in a further position of the slide after shot firing, and FIG. 15 a perspective depiction of a breech of a pistol according to FIG. 10.

DESCRIPTION OF AN EMBODIMENT

FIG. 1 shows a depicted pistol reduced to standard elements which has a frame 1 on which a slide according to FIG. 2 is arranged so as to be longitudinally displaceable. The pistol is a gas-operated loader in which a portion of the propellant gas produced when a shot is fired is directed into a gas chamber containing a gas screw 18 and a gas piston 19. The propellant gas produced when the shot is fired exerts pressure on the gas piston 19 which thereby moves axially backwards and in doing so strikes a crosspiece 13 of the slide 2. As a result, the breech 3 of the pistol, which is locked when the shot is fired, is unlocked and the slide can then move backward together with the breech and the cartridge case, whereby the further movement of the slide with the breech essentially occurs through the propellant gas acting on the cartridge case.

The breech substantially consists of a U-shaped breech locking mechanism 4 having two parallel limbs 8 and 9 with a breech face 5 arranged between them which is articulated to the breech locking mechanism 4 via a connecting shaft 29. The limbs have retaining cams 24/25 on their front underside. An upwardly projecting driving element 22 is correspondingly disposed on the front upper side, its movement controlled by a retaining element 14.

FIGS. 3 and 4 show the pistol in the rest position in which the retaining cam 24 of the locking mechanism 4 is located forward of a shoulder 26. A vertical movement of the breech locking mechanism 4 is prevented by the abutting of the retaining element 22 on the inner profile of the slide 2. In this position, the breech face 5 is in the front locked position in which the cartridge is secured in the cartridge seating 15 of the breech face 5 against backward movement.

High gas pressure is produced upon the firing pin guided through the breech face striking the cartridge, a portion of which is directed across the gas chamber to the gas piston 19 which is thus driven backward and applies momentum to the crosspiece 13 inside the slide 2. FIGS. 5 and 6 show the position of the slide immediately after a shot is fired. The gas piston 19 has moved the slide backwards so far that the driving element 22 enters into the recess 23 of the slide and a connecting bar 6 of the breech locking mechanism 4, which is supported via connecting shaft 29, can be lifted along an inclined slide surface of the retaining element 14. At the same time, the retaining cam 24 dislodges from shoulder 26.

FIGS. 7 and 8 show that by the retaining cam 24 being released, the slide 2 together with the breech 3 is able to move further backwards, taking the cartridge case along with it, until a breech piston 10 limits its movement. Since the slide was moved against the force of a spiral spring guided on a cylinder 11 during the backward movement, the spring force which built up effects the subsequent forward movement to the slide's rest position. The empty cartridge case is also thereby ejected and a new cartridge fed to the barrel from the (not depicted) magazine.

FIGS. 9A and 9B depict the breech 3 in enlarged view. The locking of the breech in the invention ensues exclusively by the breech locking mechanism 4 pivoting about a connecting shaft 29 relative to the breech face, which can only move linearly and coaxially to the barrel.

The retaining element 14 depicted in FIG. 9B exhibits an inclined slide surface at the underside, onto which the connecting bar 6 slides and is lifted during the backward movement of the slide. Although the retaining element 14 is depicted as an individual element able to be secured to the inner side of the slide 2, it can alternatively also be formed directly out of the inner profile of the slide. The connecting bar 6 can be fixedly connected to the breech locking mechanism 4 as a rod but can also be designed as a rotatable shaft.

FIG. 10, which discloses a second embodiment of the invention, shows the barrel 7 together with a gas chamber 28 and a cylinder 11 for the guiding of a spiral spring. In this respect, the structure corresponds to the pistol shown in the first embodiment. Here as well, use is made of a breech with a breech face 5 guided linearly and coaxially with the barrel 7 and articulated to a breech locking mechanism 4 via a connecting shaft 29. Here too, as FIG. 11 shows, a recess 23 is provided behind a crosspiece 13 inside the slide 2 into which a driving element 22 of the breech locking mechanism 4 can enter. Unlike in the first embodiment, however, the motion control of the breech 3 occurs at the rear end of the breech.

FIG. 12 shows a sectional view of the pistol in the rest position in which retaining cam 24 is located forward of the shoulder 26. The driving element 22 abuts against the inner profile of the slide 2 such that the breech locking mechanism is blocked in the vertical and horizontal direction.

Here as well, the gas piston 19 moves the slide backwards when a shot is fired such that, as per FIG. 13, the retaining cam 24 is able to dislodge from the shoulder 26 and the driving element 22 can enter into the recess 23. Control of the breech locking mechanism 4 pivoting is thereby effected by a locking pin 30 secured in the end of the breech 2. The breech locking mechanism 4 exhibits an oval-shaped recess 16. The locking pin 30 can slide in the recess. The profile of the recess is designed such that during its backward movement, the locking pin 30 is able to lift the breech locking mechanism 4 from a position in which the retaining cam 24 is located forward of the shoulder 26 of the frame 1 into a position in which the retaining cam is released and the retaining element 14 has entered the recess 23. To that end, the larger diameter of the oval-shaped recess 16 is designed to rise backward at an angle of 20-40° vis-à-vis the longitudinal axis of the barrel 7 so that the locking pin 30 in the rear position presses down the rear end of the breech locking mechanism 4 and thus unlocks the breech.

FIG. 14 shows the position of the slide 2 with the breech 3 in a position moved further backward.

FIG. 15 shows the breech of the second embodiment in a perspective view. The locking pin 30 is depicted as a pin here. Alternatively, the pin can also be realized by means of lugs or a crosspiece formed inside the slide.

REFERENCE NUMERALS

1 frame
2 slide
3 breech
4 breech locking mechanism
5 breech face
6 connecting bar
7 barrel
8 limb
9 limb
10 breech piston
11 cylinder
12 inclination
13 crosspiece
14 retaining element
15 seating
16 recess
17 longitudinal axis
18 gas screw
19 gas piston
20 edge
21 ejection port
22 driving element
23 recess
24 retaining cam
25 breech locking
26 shoulder
27 bore
28 gas chamber
29 connecting shaft
30 locking pin

The invention claimed is:

1. A self-loading handgun with a barrel immovably secured to a frame, a firing pin, a slide guided linearly vis-à-vis the frame, and a breech which is held in a locked position on the frame in a forward position of the slide and which is moved from the locked position into an unlocked position upon a backward movement of the slide effected by a gas pressure from a fired projectile and moved together with the slide into a rear position from which the slide together with the breech is returned to the forward position under a spring force, wherein:

the breech is of at least a two-part design comprising a breech locking mechanism with two lateral limbs and a breech face disposed between the limbs, wherein the breech locking mechanism on the limbs is provided with at least one protruding driving element which engages in a recess of the slide, and with at least one retaining cam engaging in a shoulder of the frame, the breech face and the breech locking mechanism are articulated together and the breech face incorporates an axial bore aligned with the barrel for the passage of the firing pin, and the breech face is coaxially guided to the barrel upon the backward movement and a forward movement of the slide.

2. The self-loading handgun according to claim 1, wherein the at least one retaining cam of the breech locking mechanism engages in the shoulder of the frame in the locked position of the breech, and that to unlock the breech, the at least one protruding driving element engages in the recess of the slide and releases the at least one retaining cam from the shoulder of the frame upon the backward movement of the slide.

3. The self-loading handgun according to claim 1, wherein a hook-like retaining element connected to the slide accommodated in the recess of the slide acts on the at least one protruding driving element upon the backward movement of the slide and thereby engages behind a connecting bar between the limbs of the breech locking mechanism.

4. The self-loading handgun according to claim 2, wherein a rear flank of the recess moves the at least one protruding driving element of the breech locking mechanism forward upon the forward movement of the slide.

5. The self-loading handgun according to claim 1, wherein the breech is connected to the slide by means of a guide connection such that upon the backward movement of the slide, a rear part of the breech locking mechanism is moved downward and the at least one protruding driving element engages in the recess of the slide, and that the at least one retaining cam is released from engagement in the shoulder of the frame.

6. The self-loading handgun according to claim 1, wherein the breech locking mechanism incorporates an underside inclination at a rear end which enables the breech locking mechanism to pivot vis-à-vis the breech face.

7. The self-loading handgun according to claim 5, wherein the guide connection between the breech locking mechanism and the slide is effected by a locking pin supported in an oval-shaped recess of the breech locking mechanism running in a longitudinal direction of the handgun.

8. The self-loading handgun according to claim 7, wherein the locking pin is disposed in the forward position of the oval-shaped recess when the slide is at rest and, upon a shot being fired, is moved backward into the rear position of the oval-shaped recess from the backward movement of the slide, wherein the oval-shaped recess is designed with a rearward rising inclination.

9. The self-loading handgun according to claim 7, wherein a larger diameter of the oval-shaped recess runs at an angle of 20-40° vis-à-vis a longitudinal axis of the barrel of the handgun.

10. The self-loading handgun according to claim 1, wherein sliding surfaces between the at least one protruding driving element and the recess of the slide and/or between the at least one retaining cam and the shoulder of the frame are beveled or rounded in a longitudinal direction of the frame.

11. The self-loading handgun according to claim 1, wherein upon a fired projectile being shot, the gas pressure is directed to a rear of a gas piston running parallel to the barrel which triggers an unlocking of the breech by the slide and the backward movement of the slide together with the breech.

12. The self-loading handgun according to claim 1, wherein upon moving backward, the slide carries along a fired cartridge casing and ejects it from an ejection port of the slide and that after the fired cartridge casing has been ejected, a cartridge disposed in a magazine is brought into a path of the barrel under a spring force and pushed into the barrel by means of the breech moving forward again.

* * * * *